US007434954B1

(12) United States Patent
Edgar

(10) Patent No.: US 7,434,954 B1
(45) Date of Patent: Oct. 14, 2008

(54) ADJUSTABLE MOUNT FOR FLASHLIGHT

(76) Inventor: Mark Edgar, 110 Artlee Ave., Butler, PA (US) 16001

( * ) Notice: Subject to any disclaimer, the term of this patent is extended or adjusted under 35 U.S.C. 154(b) by 0 days.

(21) Appl. No.: 11/308,322

(22) Filed: Mar. 16, 2006

(51) Int. Cl.
*F21L 4/00* (2006.01)

(52) U.S. Cl. ..... 362/197; 362/198; 362/199

(58) Field of Classification Search ..... 362/189–191, 362/398, 426, 427, 419, 197–202
See application file for complete search history.

(56) References Cited

U.S. PATENT DOCUMENTS 4,348,716 A * 9/1982 Storm et al. ..... 362/191
4,376,965 A * 3/1983 Bacevius ..... 362/191
4,506,317 A * 3/1985 Duddy ..... 362/396
4,895,329 A * 1/1990 Sloan ..... 248/229.16
4,897,768 A * 1/1990 Thul ..... 362/191
4,938,440 A * 7/1990 Weinfield ..... 248/183.1
5,178,453 A * 1/1993 Runels ..... 362/398
5,278,739 A * 1/1994 Gammache ..... 362/197
5,515,246 A * 5/1996 Maglica ..... 362/473
5,577,697 A * 11/1996 Accordino ..... 248/206.5
5,595,436 A * 1/1997 Way et al. ..... 362/190
5,678,921 A * 10/1997 Kish et al. ..... 362/205
5,893,630 A * 4/1999 Mosquera ..... 362/191
6,158,876 A * 12/2000 Birdwell ..... 362/208
6,206,542 B1 * 3/2001 Case et al. ..... 362/190
6,644,827 B2 11/2003 Birdwell
6,726,342 B1 * 4/2004 Lai ..... 362/188
2004/0228120 A1 * 11/2004 Ross ..... 362/110
2005/0265033 A1 * 12/2005 Yang ..... 362/398

* cited by examiner

*Primary Examiner*—Mariceli Santiago
(74) *Attorney, Agent, or Firm*—John J. Elnitski, Jr.

(57) ABSTRACT

An adjustable mount for a flashlight. The adjustable mount having a flashlight receiving body adapted to receive a flashlight. The adjustable mount having a connecting body rotatably connected to the flashlight receiving body at a right angle such that the flashlight receiving body rotates about the connecting body at the connection between the flashlight receiving body and the connecting body. The adjustable mount having a support body rotatably connected to the connecting body at a right angle such that the support body rotates about the connecting body at the connection between the support body and the connecting body.

18 Claims, 16 Drawing Sheets

ADJUSTABLE MOUNT FOR FLASHLIGHT

BACKGROUND

The present invention generally relates to flashlights. More specifically, the present invention relates to flashlights with adjustable mounts.

Mechanics, installers, repairpersons and the like commonly have the need to apply portable lighting to their work and, particularly, to aim a beam of light, such as from a flashlight, on a particular portion of the work while the hands remain free to perform operations on the work or to hold tools. It is therefore often desired to adjustably and temporarily fix the flashlight or other light source in space at a particular location and orientation. However, the light must be attached to or rest upon something if it is not held by the worker's hand, and it is not generally the case that the work or site has a specialized provision for this purpose. A common but inconvenient solution to this problem is for the worker to hold the butt of the flashlight in his or her mouth. Most times when a flashlight is needed, there is a magnetic surface nearby. Most available flashlight mounts are flimsy. What is needed is an adjustable flashlight mount which can be connected to a magnetic surface and is compact and of solid construction.

It is an object of the present invention to provide an adjustable mount for a flashlight which can be mounted a surface by a magnetic connection.

It is another object of the present invention to provide an adjustable mount for a flashlight which may be adjusted to direct light from the flashlight in a desired direction.

SUMMARY OF THE INVENTION

An adjustable mount for a flashlight. The adjustable mount having a flashlight receiving body adapted to receive a flashlight. The adjustable mount having a connecting body rotatably connected to the flashlight receiving body at a right angle such that the flashlight receiving body rotates about the connecting body at the connection between the flashlight receiving body and the connecting body. The adjustable mount having a support body rotatably connected to the connecting body at a right angle such that the support body rotates about the connecting body at the connection between the support body and the connecting body.

DETAILED DESCRIPTION

The present invention is an adjustable mount for a flashlight that is compact and of solid construction, as shown in FIGS. 1-16. FIGS. 1-12 show a integrated flashlight embodiment 10. FIGS. 13-16 show a removable flashlight embodiment 12.

Figure 1:
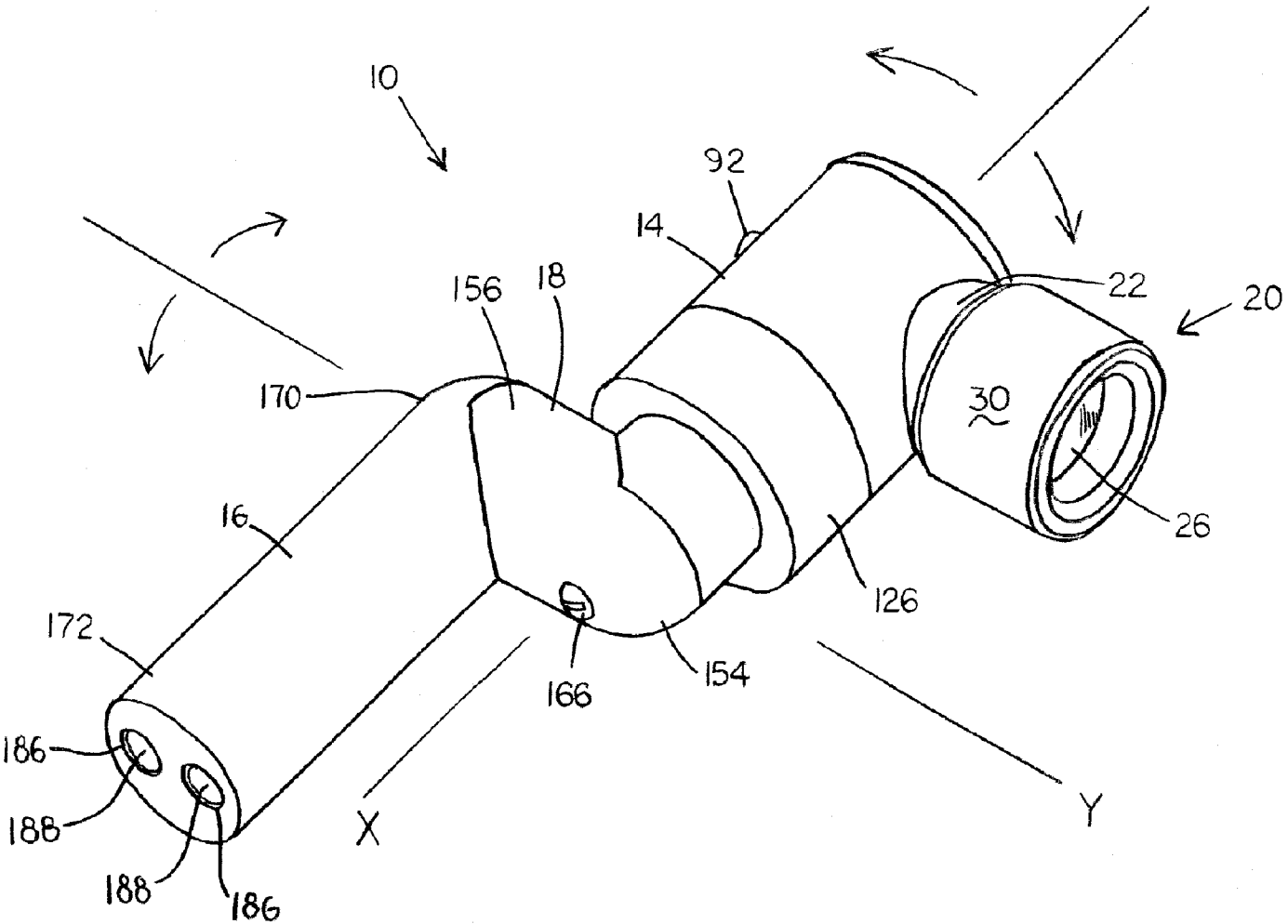
FIG. 1 is a perspective view of an adjustable mount for a flashlight with an integrated flashlight according to the present invention.

FIG. 1 shows an adjustable mount with an integrated flashlight. The adjustable mount includes a flashlight receiving body 14, a support body 16 and a connecting body 18. The flashlight receiving body 14 retains the integrated flashlight 20. The connecting body 18 interconnects the flashlight receiving body 14 and the support body 16. The support body 16 provides support to position the flashlight 20 for the user. As shown in FIG. 1, the flashlight receiving body 14 and the support body 16 rotate about the connecting body 18. The flashlight receiving body 14 rotates about the X-axis at the connecting body 18. The support body 16 rotates about the Y-axis at the connecting body 18. Once the support body 16 is positioned, the flashlight 20 can be aimed in a specific direction by rotating the connecting body 18 about the support body 16 and rotating the flashlight receiving body 14 about the connecting body 18.

Figure 2:
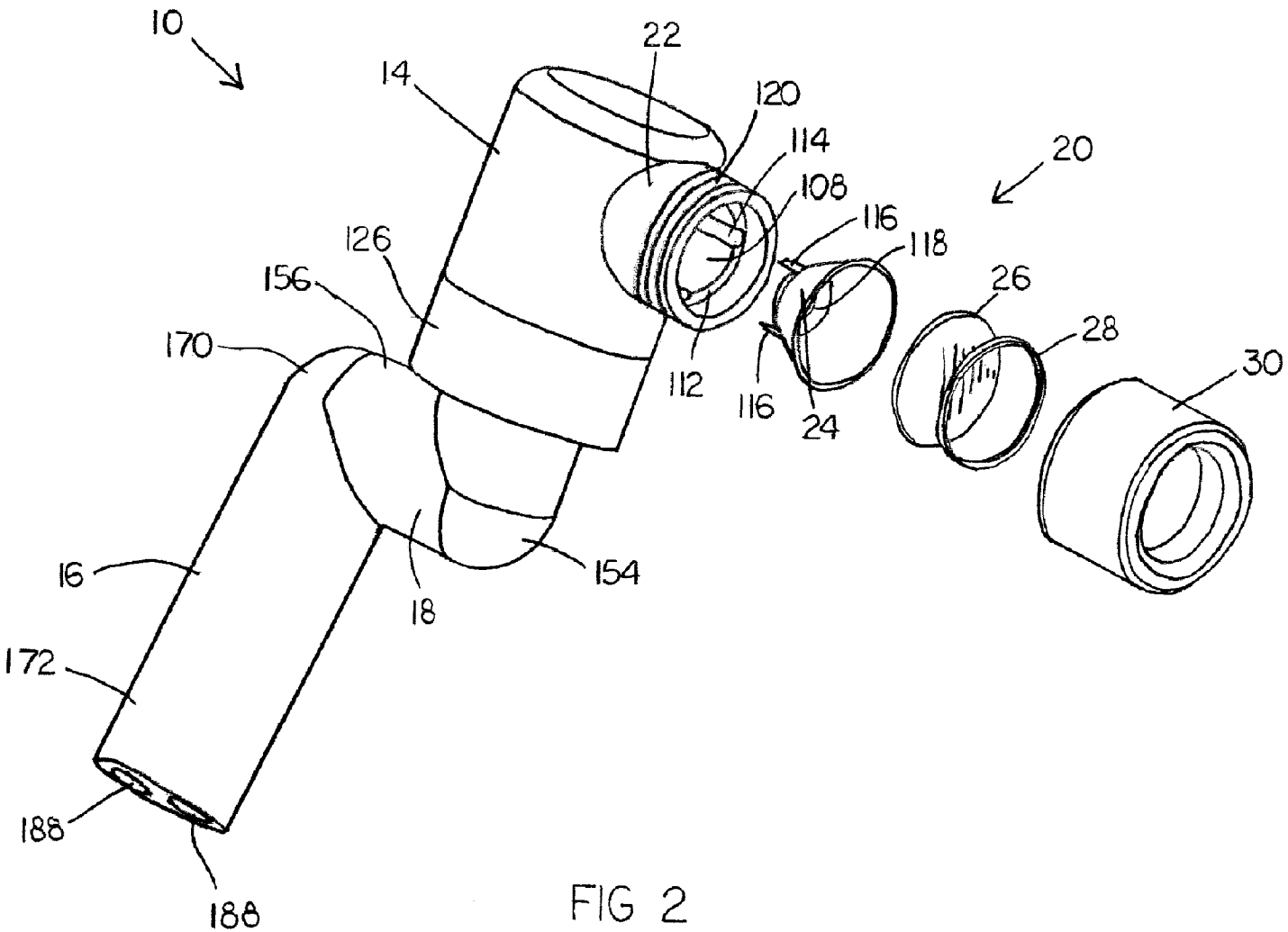
FIG. 2 is a partial exploded view of the adjustable mount for a flashlight of FIG. 1 according to the present invention.
Figure 3:
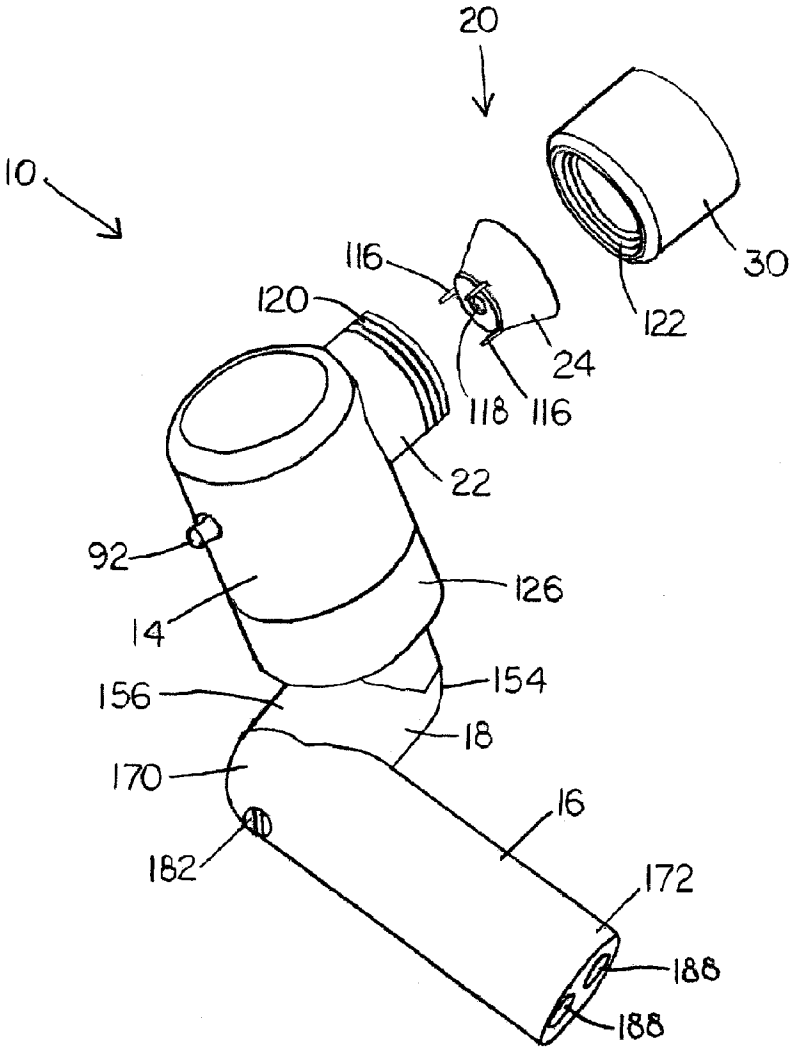
FIG. 3 is a partial exploded view of the adjustable mount for a flashlight of FIG. 1 according to the present invention.
Figure 4:
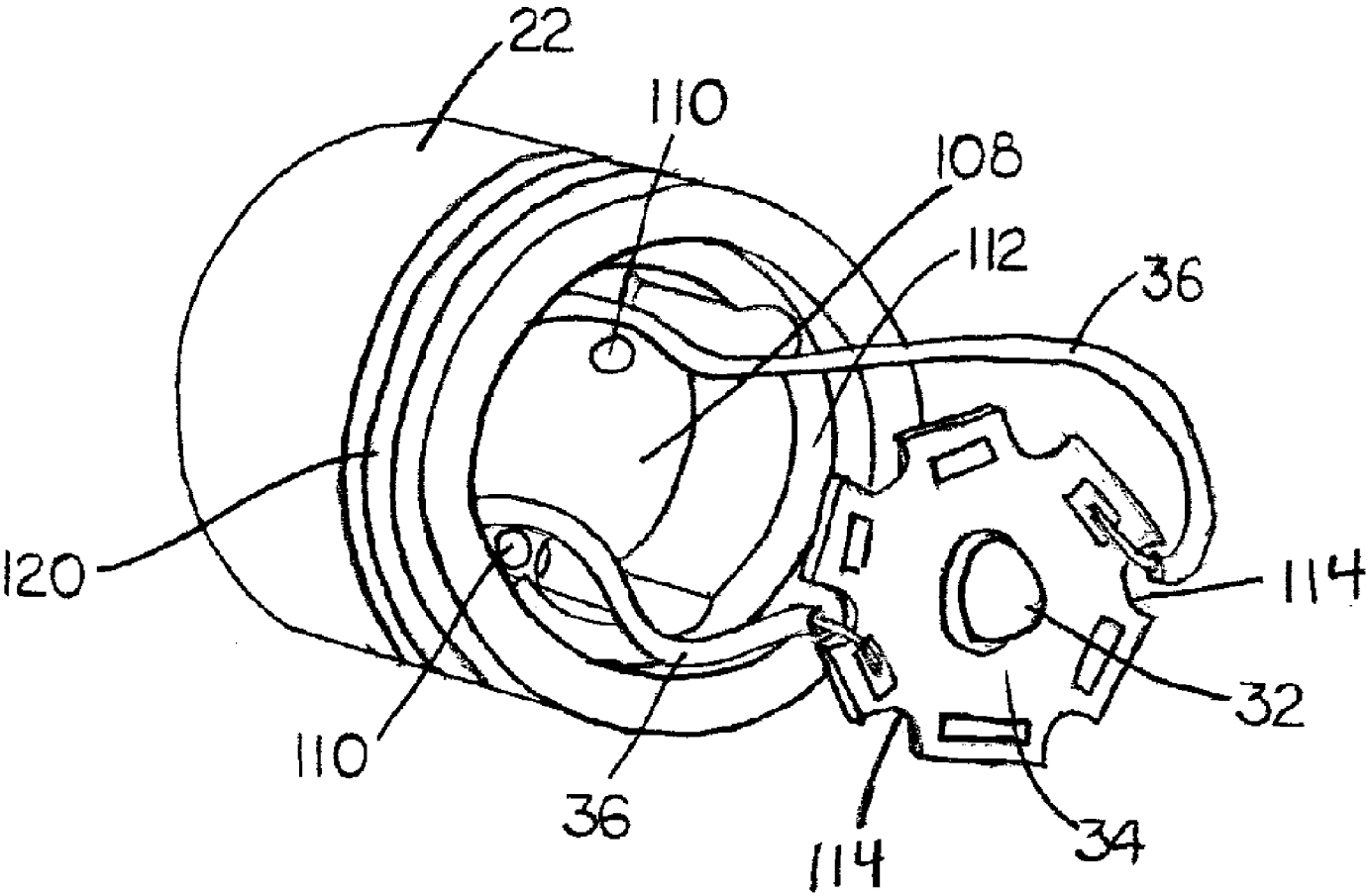
FIG. 4 is a perspective view of a flashlight body according to the present invention.
Figure 5:
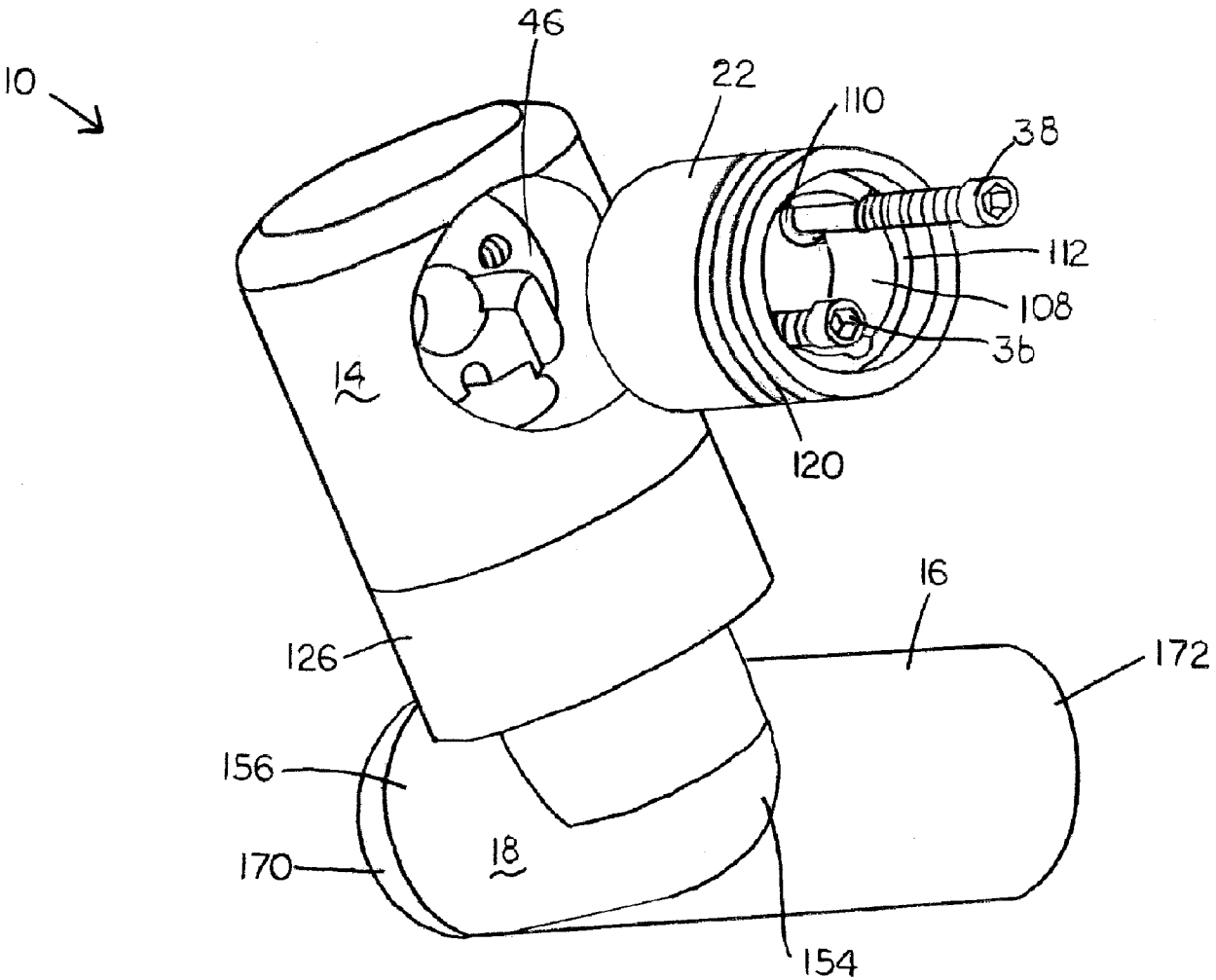
FIG. 5 is a partial exploded view of the adjustable mount for a flashlight of FIG. 1 according to the present invention.
Figure 6:
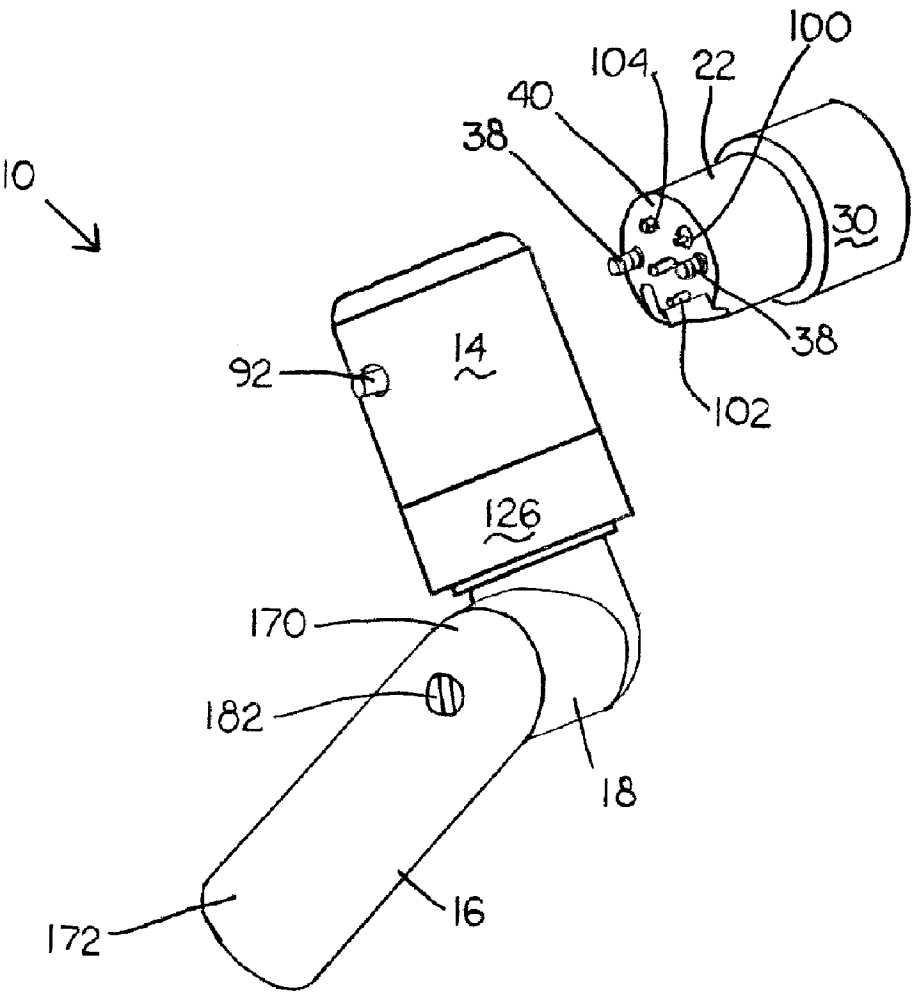
FIG. 6 is a partial exploded view of the adjustable mount for a flashlight of FIG. 1 according to the present invention.
Figure 7:
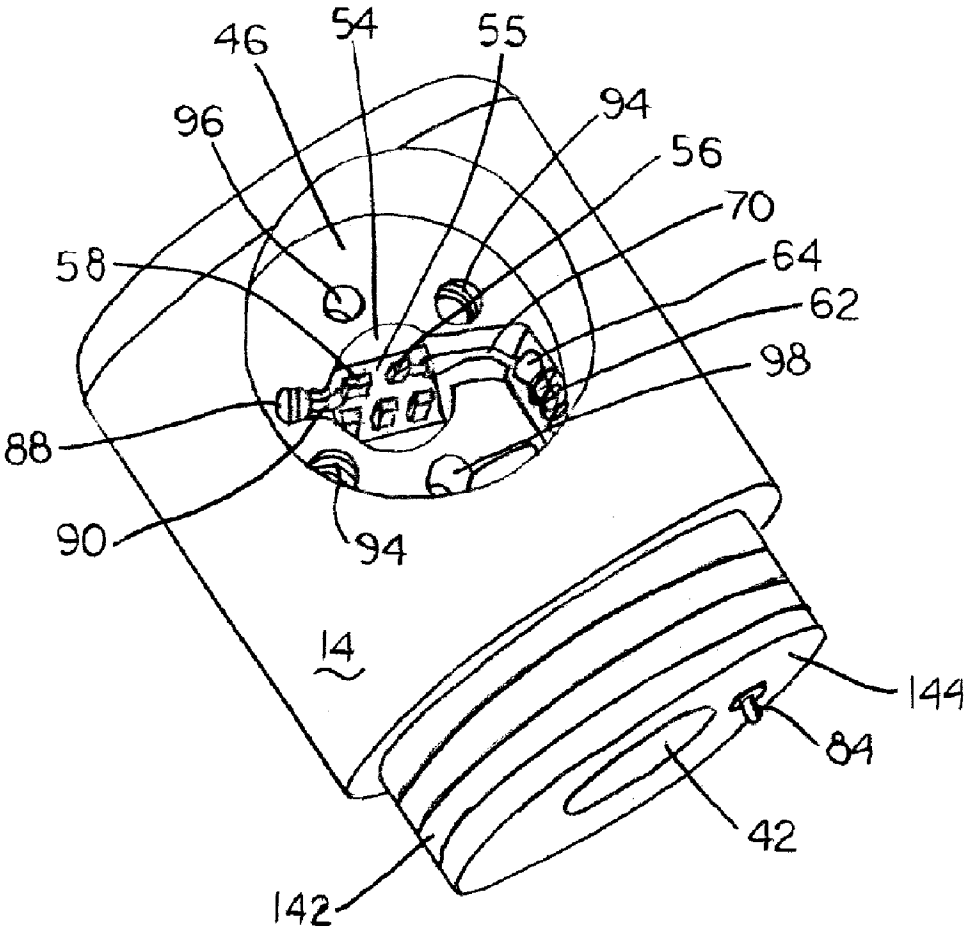
FIG. 7 is a perspective view of a flashlight receiving body according to the present invention.
Figure 8:
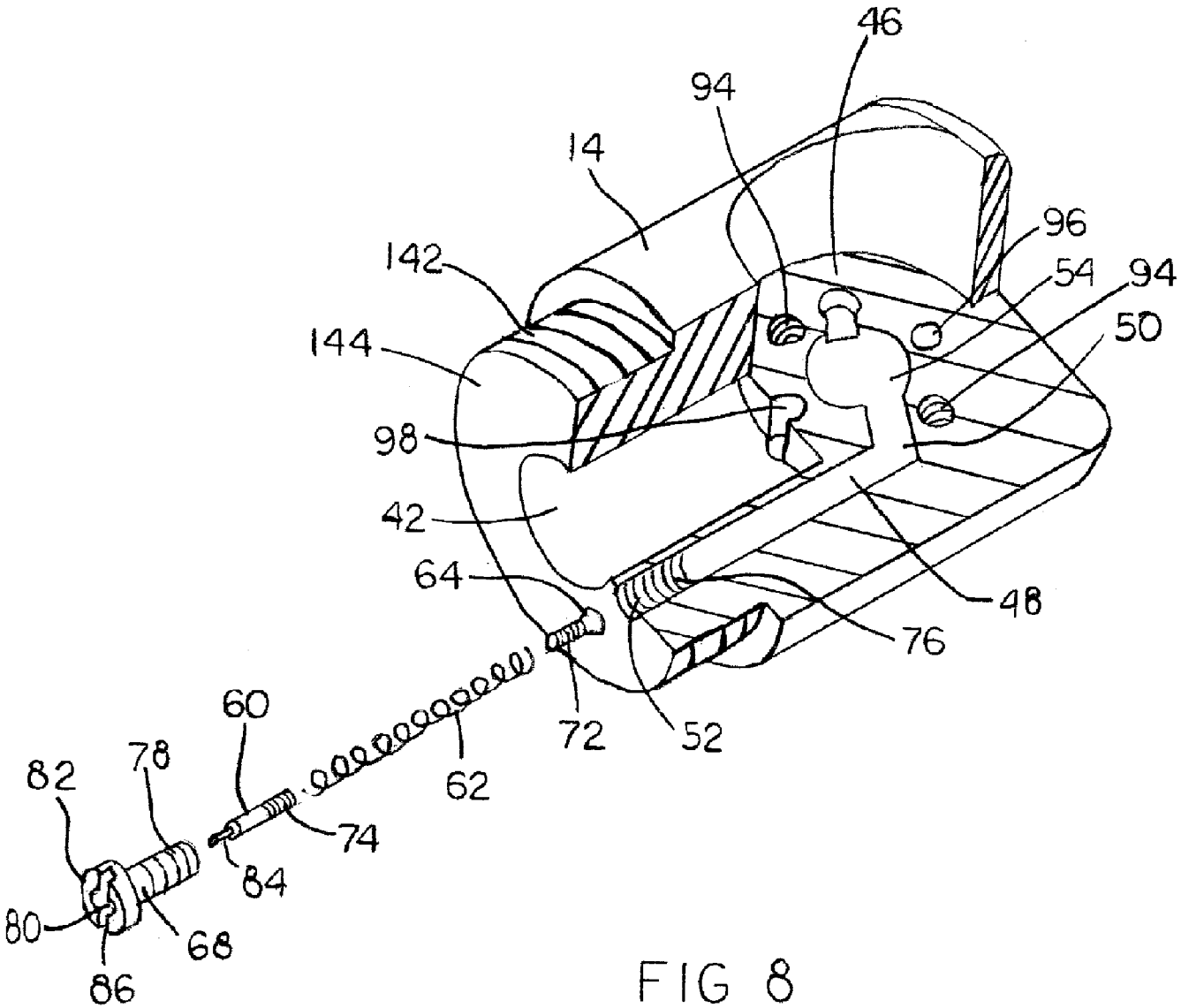
FIG. 8 is a cutaway view of the flashlight receiving body of FIG. 7 according to the present invention.

FIG. 2 shows an exploded view of the front of the integrated flashlight 20. Shown in FIG. 2 are a flashlight body 22, bulb reflector 24, lens 26, lens gasket 28 and flashlight head 30 in relation to the adjustable mount. FIG. 3 shows a different view of the flashlight body 22, bulb reflector 24 and flashlight head 30 in relation to the adjustable mount. FIG. 4 shows the flashlight body 22 with an LED bulb 32 mounted to a circuit board 34. Wires 36 extend from the circuit board 34 into the flashlight body 22 and provide power to the LED bulb 32. FIG. 5 shows how the flashlight body 22 is mounted into the flashlight receiving body 14 using two alien screws 38. FIG. 6 shows the rear 40 of the flashlight body 22 with the flashlight head 30 on the flashlight body 22. FIG. 7 shows the flashlight receiving body 14 apart from the connecting body 18 and with the flashlight body 22 removed. FIG. 8 shows a cut-away view of the flashlight receiving body 22.

Figure 9:
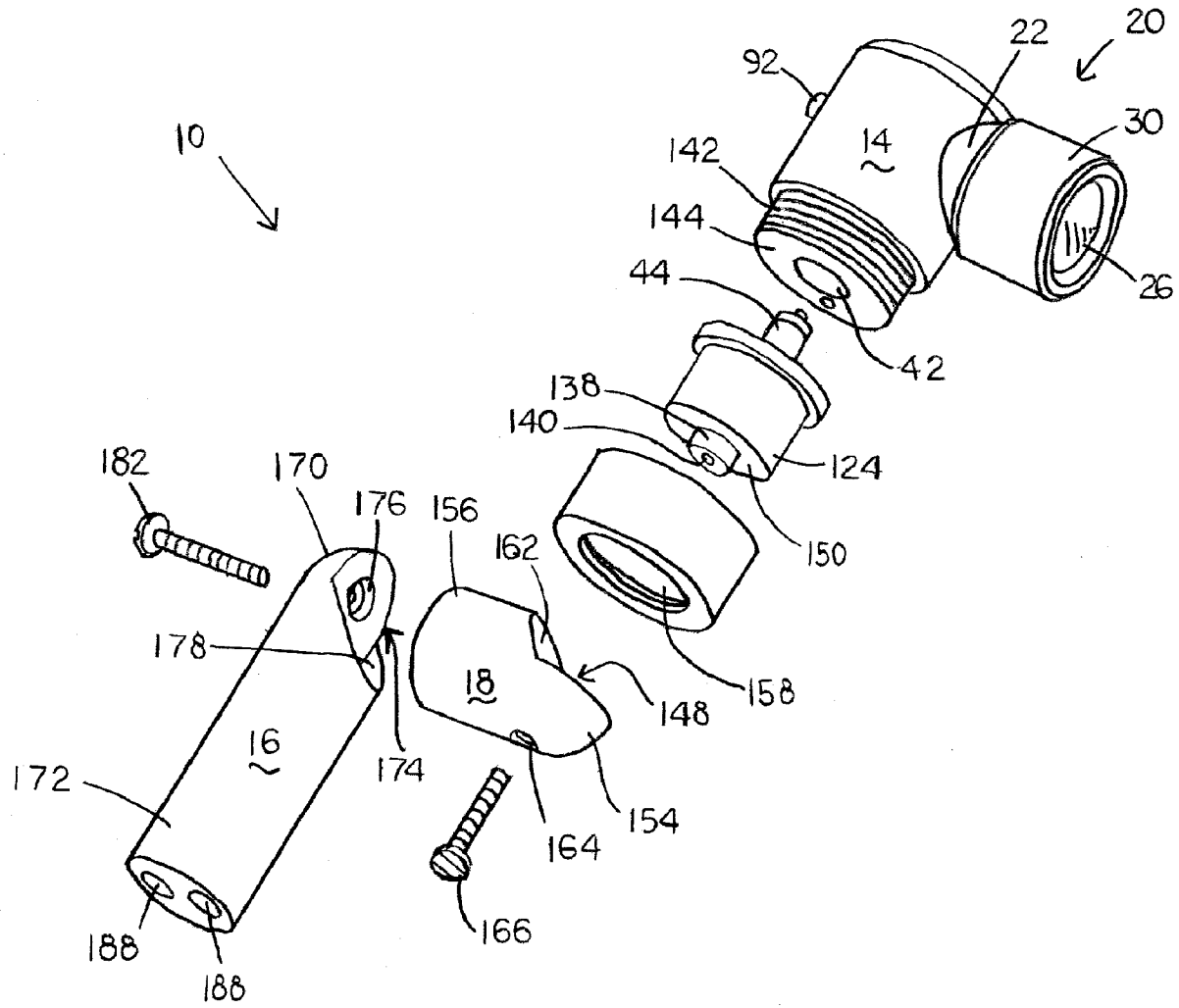
FIG. 9 is a partial exploded view of the adjustable mount for a flashlight of FIG. 1 according to the present invention.

The flashlight receiving body 14 includes a battery socket 42 to receive a battery 44, as shown in FIGS. 7-9. The battery 44 is shown in FIG. 9. The flashlight receiving body 14 includes a flashlight body socket 46 to receive the flashlight body 22, as shown in FIGS. 5 and 7-8. FIG. 8 shows a negative pin channel 48 to receive a negative pin assembly. The negative pin channel 48 has a top 50, bottom 52 and leads to a switch cavity 54. The switch cavity 54 includes internal mechanics of a switch 55 (not shown) and a first switch contact 56 and second switch contact 58, as shown in FIG. 7. The negative pin assembly includes a negative pin 60, pin spring 62, internal pin contact 64 and pin retainer 68. The internal pin contact 64 is mounted into the top 50 of the negative pin channel 48 and is wired to the first switch contact 56 in the switch cavity 54 by using a wire 70 for a negative connection, as shown in FIG. 7. The pin spring 62 screws onto a threaded section 72 of the internal pin contact 64 and onto a threaded section 74 of the negative pin 60. The bottom 52 of the negative pin channel 48 includes a threaded section 76 to receive a threaded body 78 of the pin retainer 68. The threaded body 78 of the pin retainer 68 is hollow and leads to a pin tip hole 80 at a head 82 of the pin retainer 68. The pin tip hole 80 is only large enough to allow passage of a pin tip 84 of the negative pin 60. The hollow threaded body 78 allows for insertion of the negative pin 60, such that the pin tip 84 extends out from the pin retainer 68 at the pin tip hole 80. The pin spring 62 allows movement of the negative pin 60 between the head 82 of the pin retainer 68 and the internal pin contact 64. The pin spring 62 is made of a electrical conducting material. The head 82 of the pin retainer 68 includes a slot 86 to allow the use of a screw driver.

FIG. 7 shows a negative contact 88 mounted in the flashlight body socket 46. The negative contact 88 of the flashlight body socket 46 is wired to the second switch contact 58 in the switch cavity 54 using a wire 90 for the negative connection. FIGS. 1, 3, 6 and 9-12 show a flashlight button 92 which is internally contacted to the mechanics of the switch. FIG. 8 shows two threaded flashlight body screw holes 94, a position stud hole 96 and a positive contact slot 98. FIG. 6 shows the two alien screws 38, a negative contact 100, a positive contact 102 and a position stud 104, which all extend out from the rear 40 of the flashlight body 22. The threaded flashlight body screw holes 94 are for receiving the alien screws 38 of the flashlight body 22 to secure the flashlight body 22 in the flashlight body socket 46. The positive contact 102 is a pin which extends out from the rear 40 of the flashlight body 22 and slides into the positive contact slot 98. The positive contact 102 is positioned such that part of the pin extends into the battery socket 42 and is able to contact the positive end 106 of the battery 44, when the battery 44 is in the battery socket 42. The negative contact 100 extending from the rear 40 of the flashlight body 22 is a spring loaded pin that is aligned to contact the negative contact 88 of the flashlight body socket 46, when the flashlight body 22 is secured in the flashlight body socket 46. The negative contact 100 of the flashlight body 22 is spring loaded to allow for the pin to be pressured against the negative contact 88 of the flashlight body socket 46. The position stud hole 96 is for receiving the position stud 104 of the flashlight body 22 to ensure proper alignment of the negative contact 100 of the flashlight body 22 with the negative contact 88 of the flashlight body socket 46.

The flashlight body 22 includes a bulb cavity 108 as shown in FIGS. 2, 4 and 5. The bulb cavity 108 includes screw holes 110 which lead to the rear 40 of the flashlight body 22 to allow passage of the alien screws 38. The bulb cavity 108 includes the positive contact 102 and the negative contact 100 of the flashlight body 22 extending into the bulb cavity 108 to allow connection with the wires 36 from the circuit board 34. Once the flashlight body 22 is secured in the flashlight body socket 46 with the alien screws 38, the wires 36 of the circuit board 34 are connected to the positive contact 102 and the negative contact 100 of the flashlight body 22. The bulb cavity 108 includes a lip 112 for the circuit board 34 to rest upon, as shown in FIG. 4. The circuit board 34 includes reflector slots 114 to receive alignment legs 116 extending from the bulb reflector 24. The bulb reflector 24 is the standard shape for a bulb reflector and includes a bulb hole 118. The bulb reflector 24 is placed over the bulb 32 such that the bulb 32 extends into the bulb hole 118 of the bulb reflector 24, when the bulb reflector 24 is installed into the bulb cavity 108. The lens 26 is slightly larger in diameter than the bulb reflector 24 and rests against the bulb reflector 24 to protect the bulb 32. The lens gasket 28 rest against the lens 26 and is positioned between the lens 26 and the inside of the flashlight head 30. The lens gasket 28 provides a seal between the lens 26 and the flashlight head 30. The flashlight body 22 includes outside 120 threads and the flashlight head 30 includes inside threads 122, as shown in FIG. 3. The flashlight head 30 screws onto the flashlight body 22 to secure the bulb 32, bulb reflector 24, lens 26 and lens gasket 28 in place.

Figure 10:
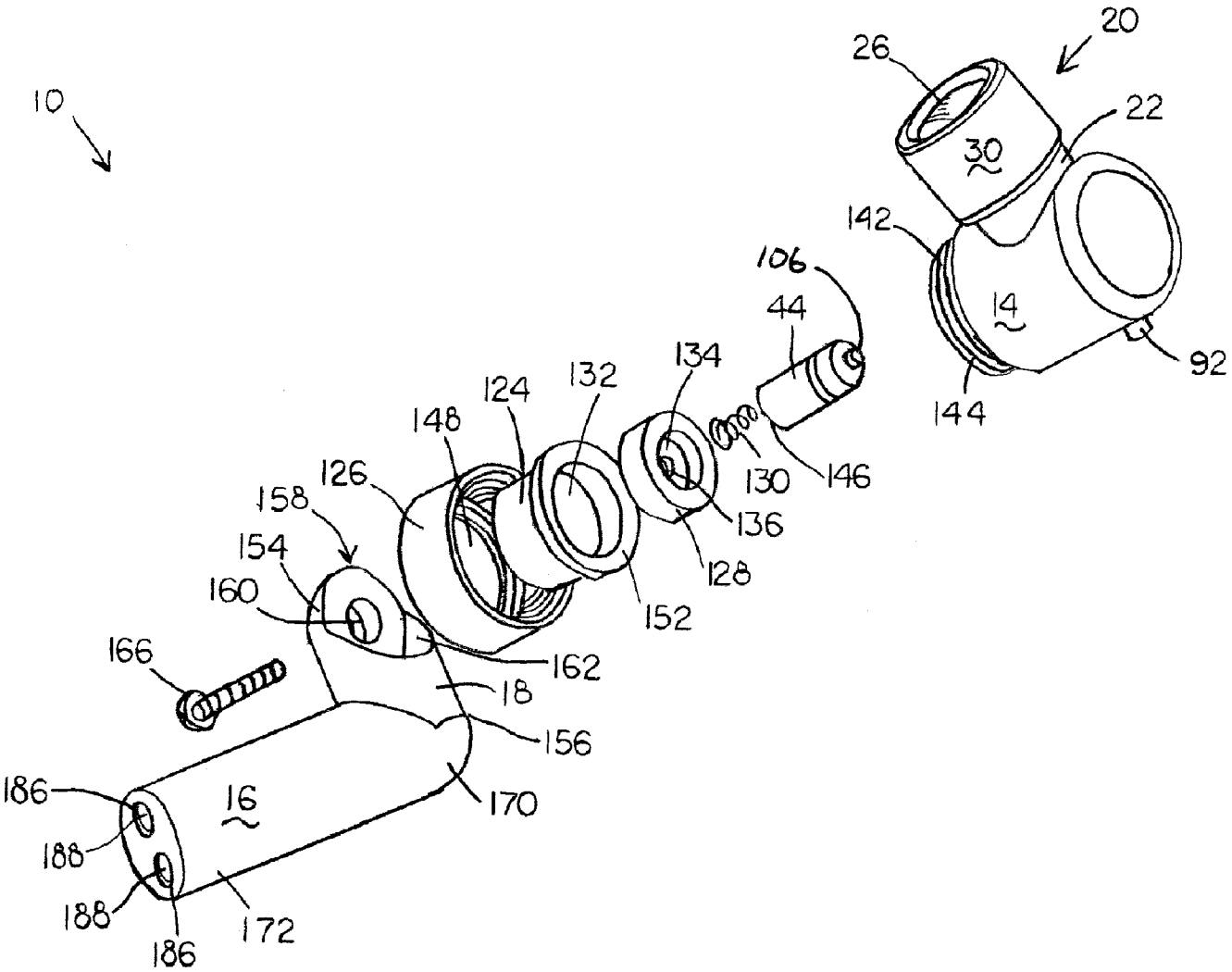
FIG. 10 is a partial exploded view of the adjustable mount for a flashlight of FIG. 1 according to the present invention.
Figure 12:
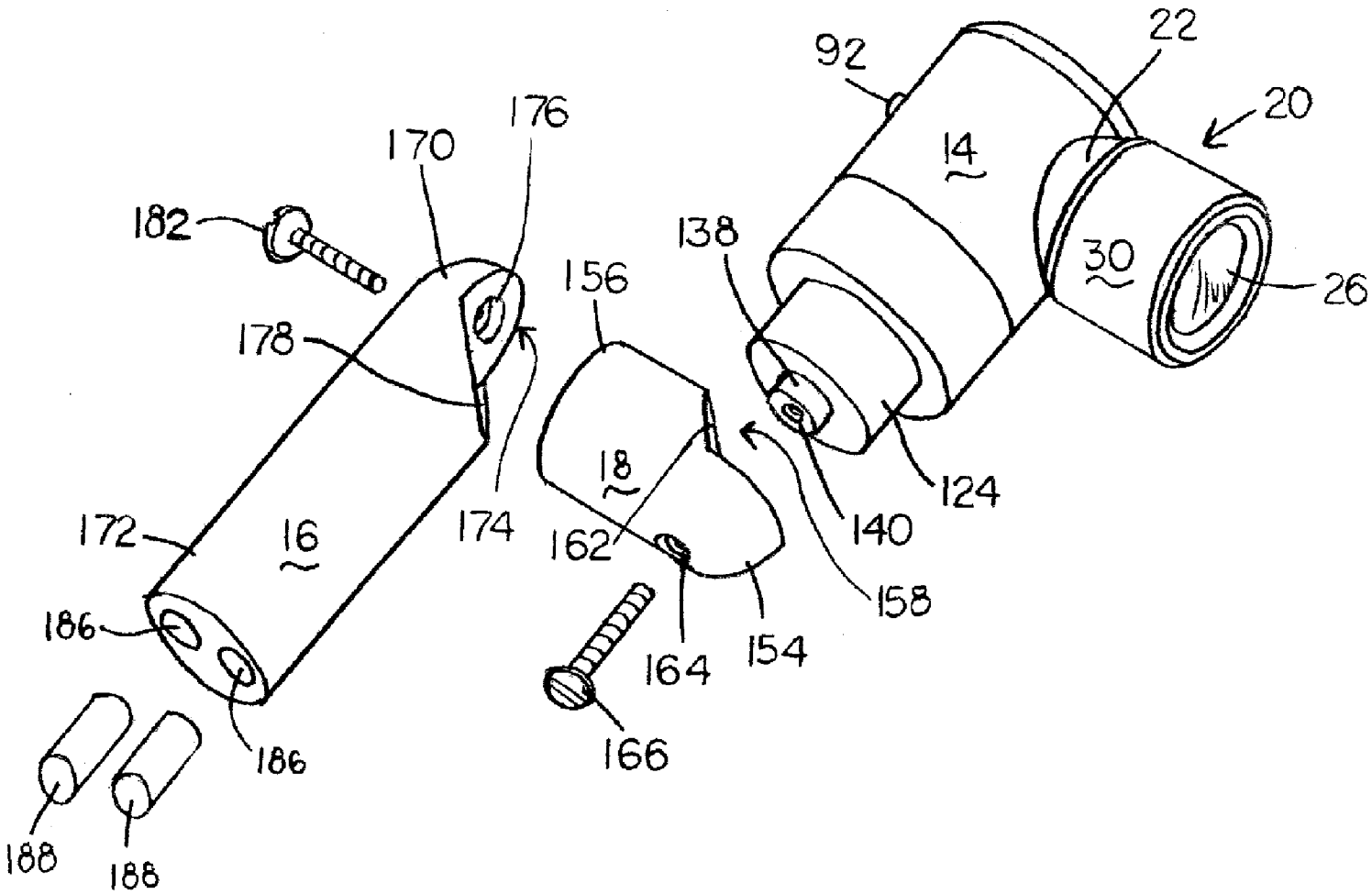
FIG. 12 is a partial exploded view of the adjustable mount for a flashlight of FIG. 1 according to the present invention.

FIGS. 9-10 shown the disassembly of flashlight receiving body 14 in relation to the connecting body 18. The flashlight receiving body 14 also includes rotation end 124, rotation end cap 126, conducting surface 128 and battery spring 130. The rotation end 124 includes a conducting surface cavity 132 and the conducting surface 128 includes a battery cavity 134, as shown in FIG. 10. The conducting surface 128 rests in the conducting surface cavity 132 of the rotation end 124. The battery cavity 134 of the conducting surface 128 includes a spring cavity 136 to receive the battery spring 130. The rotation end 124 includes a rotation boss 138 with a screw hole 140, as shown in FIGS. 9 and 12. The flashlight receiving body 14 includes threads 142 about the outside surface near a bottom 144 of the flashlight receiving body 14. The battery 44 is placed in the battery socket 42, so that positive end 106 of the battery 44 contacts the positive contact 102 of the flashlight body 22. The assembled rotation end 124, conducting surface 128 and battery spring 130 are placed toward the bottom 144 of the flashlight receiving body 14, such that the negative end 146 of the battery 44 rests in the battery cavity 134 of conducting surface 128 and against the battery spring 130. The battery spring 130 and the conducting surface 128 are both of an electrical conducting material and form an electrical connection from the negative end 146 of the battery 44 to the conducting surface 128 via the battery spring 130. The rotation end cap 126 includes a center hole 148 to allow passage of the rotation boss 138, as the rotation end cap 126 is threaded onto the flashlight receiving body 14 and against the bottom 150 of the rotation end 124. When the rotation end 124 is mounted to the flashlight receiving body 22, a top 152 of the conducting surface 128 contacts the pin tip 84 of the negative pin 60. This provides an electrical connection from the negative end 146 of the battery 44 to the first switch contact 56 which is connected to internal pin contact 64 of the negative pin assembly.

Figure 11:
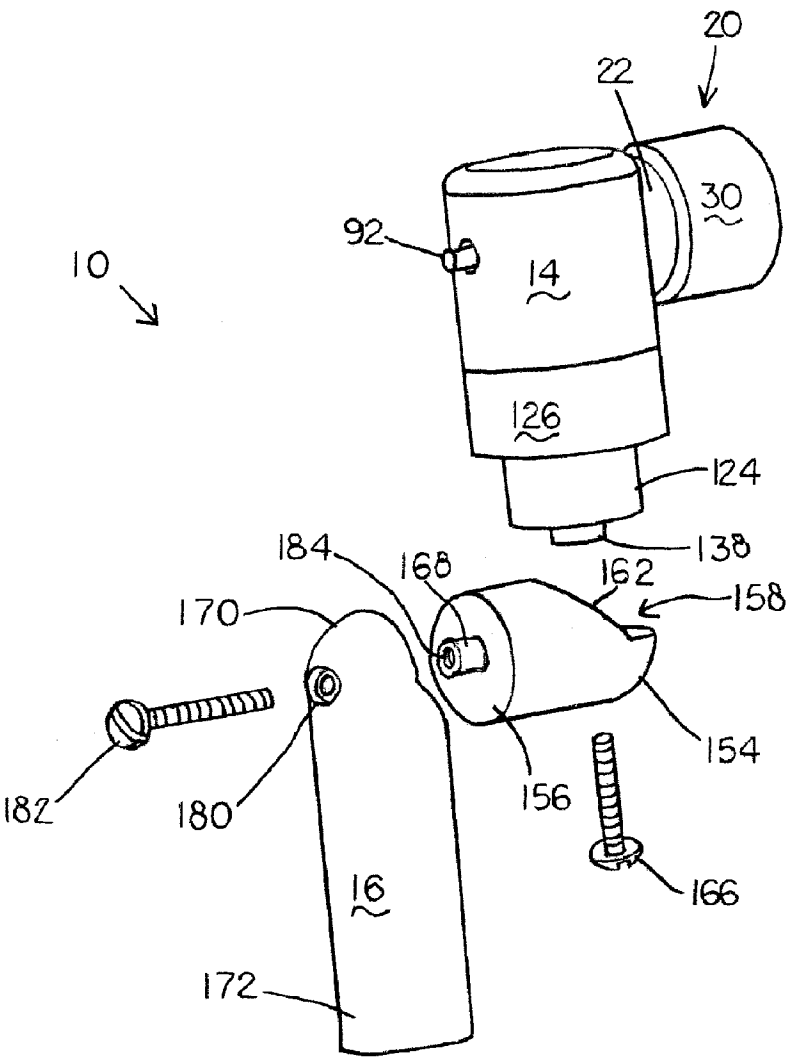
FIG. 11 is a partial exploded view of the adjustable mount for a flashlight of FIG. 1 according to the present invention.

The connecting body 18 has a flashlight end 154 and a support body end 156. FIG. 10 shows a round cutout 158 at the flashlight end 154. There is a rotation boss socket 160 in the round cutout 158 of the flashlight end 154. The round cutout 158 is large enough to receive the rotation end cap 126, but small enough so there is a slight amount of friction between the rotation end cap 126 and a remaining portion 162 of the connecting body 18 at the round cutout 158. The rotation boss 138 of the flashlight receiving body 14 fits into the rotation boss socket 160 of the connecting body 18, when the flashlight receiving body 14 is secured to the connecting body 18. There is a hole 164 in the flashlight end 154 of the connecting body 18 from the rotation boss socket 160 to the outside of the connecting body 18. A screw 166 is inserted into the hole 164 of the flashlight end 154 and screwed into the screw hole 140 of the rotation boss 138, in order to secure the flashlight receiving body 14 and the connecting body 18 together. As shown in FIG. 11, the support body end 156 of the connecting body 18 is round with a rotation boss 168 extending outward. The support body 16 includes a connecting body end 170 and a support end 172. The connecting body end 170 of the support body 16 includes a round cutout 174 similar to the round cutout 158 of the flashlight end 154 of the connecting body 18. There is a rotation boss socket 176 in the round cutout 174 of the connecting body end 170 of the support body 16 to receive the rotation boss 168 of the connecting body 18. The rotation boss 168 of the connecting body 18 fits into the rotation boss socket 176 of the support body 16, when the connecting body 18 is secured to the support body 16. The round cutout 174 of the connecting body end 174 of the support body 16 is large enough to receive the support body end 156 of the connecting body 18, but small enough so there is a slight amount of friction between the support body end 156 of the connecting body 18 and a remaining portion 178 of the support body 16 at the round cutout 174 of the connecting body end 174 of the support body 16. There is a hole 180 in the connecting body end 174 of the support body 16 from the rotation boss socket 176 to the outside of the support body 16. A screw 182 is inserted into the hole 180 of support body 16 and screwed into a screw hole 184 of the rotation boss 168 of the connecting body 18, in order to secure the support body 16 and the connecting body 18 together. The support end 172 of the support body 16 includes two magnet sockets 186, as shown in FIG. 12. FIG. 12 shows two magnets 188 which are secured in the magnet sockets 186, as shown in FIGS. 1-3, and 9-10.

Operation of the adjustable mount with the integrated flashlight is as follows. The support body 16 is positioned on a piece of magnetic material, such that the magnets 188 of the support end 172 make magnetic contact with the magnetic material. The support body 16 can then free stand due to the magnetic connection to the magnetic material and provide support for the flashlight 20. In order to point the flashlight 20 in a particular direction, the connecting body 18 is rotated at the connecting body end 170 of the support body 16 and flashlight receiving body 14 is rotated at the flashlight end 154 of the connecting body 18. Rotation at both ends of the connecting body 18 provides three-dimensional positioning of the flashlight 20 between the X-axis and Y-axis shown in FIG. 1. The flashlight button 92 extending from the flashlight receiving body 14 is manipulated to provide a connection between the first switch contact 56 and second switch contact 58. When there is a connection between the first switch contact 56 and second switch contact 58, there is a connection between the negative battery end 146 and the negative wire of the wires 36 from the bulb 32 to produce light, as the positive end 106 of the battery 44 is always connected to the bulb 32 via the positive wire of the wires 36.

Figure 13:
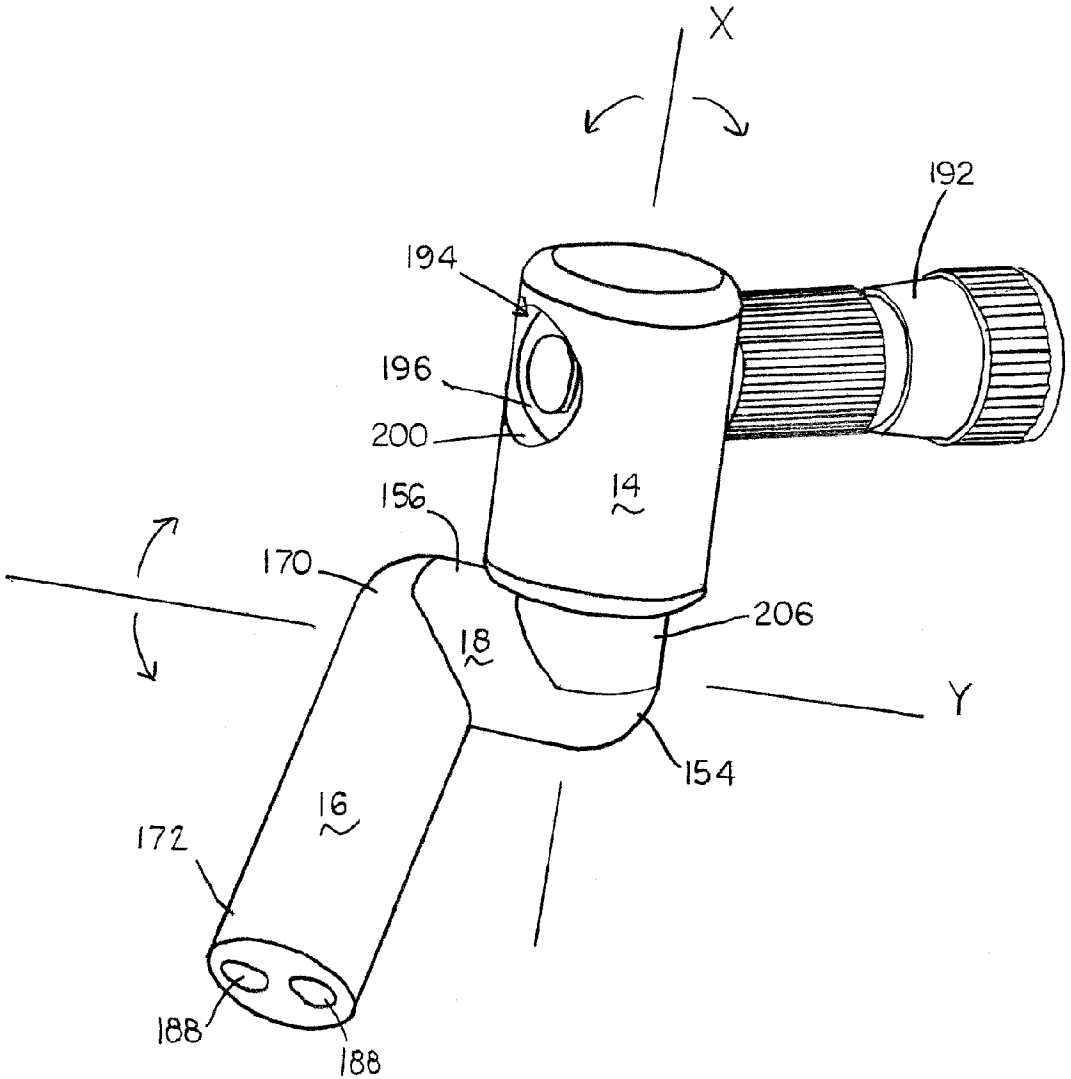
FIG. 13 is a perspective view of an adjustable mount for a flashlight which can receive an existing flashlight according to the present invention.
Figure 14:
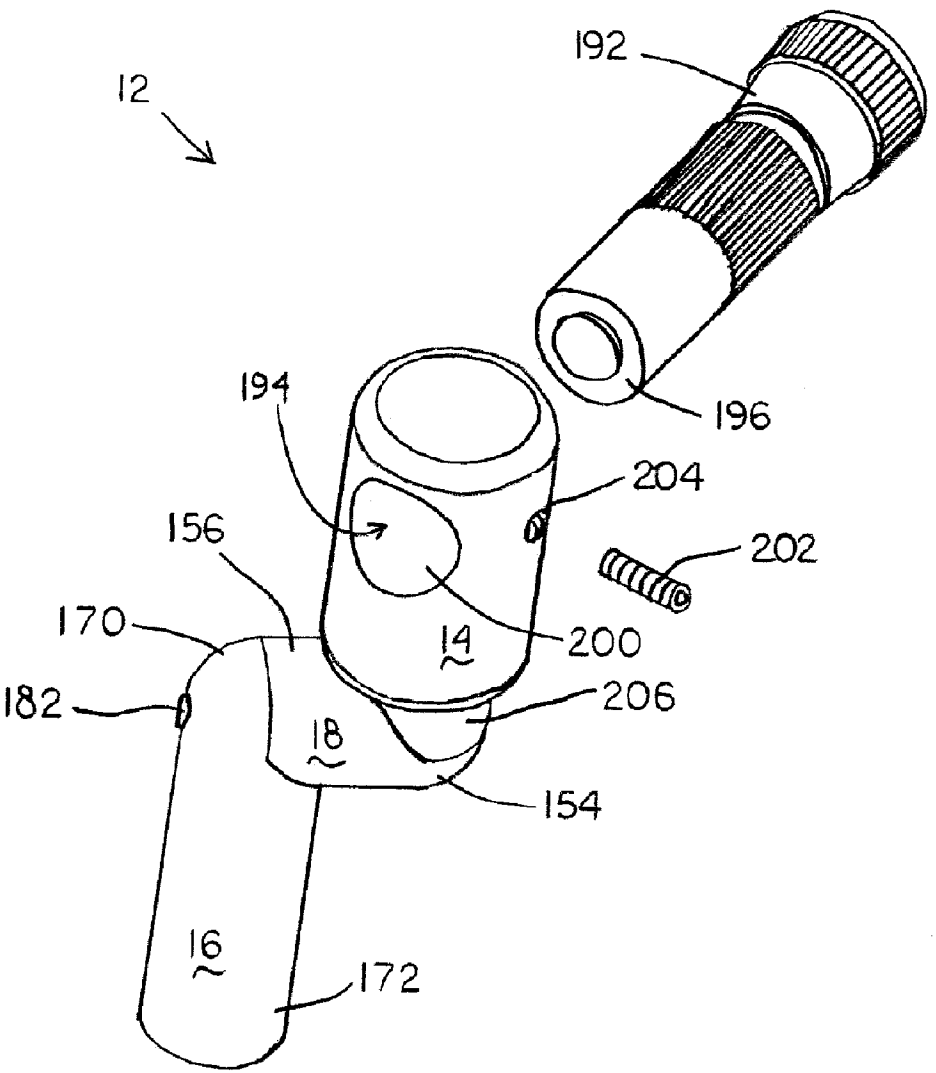
FIG. 14 is a perspective view of an adjustable mount of FIG. 13 with the flashlight removed according to the present invention.
Figure 15:
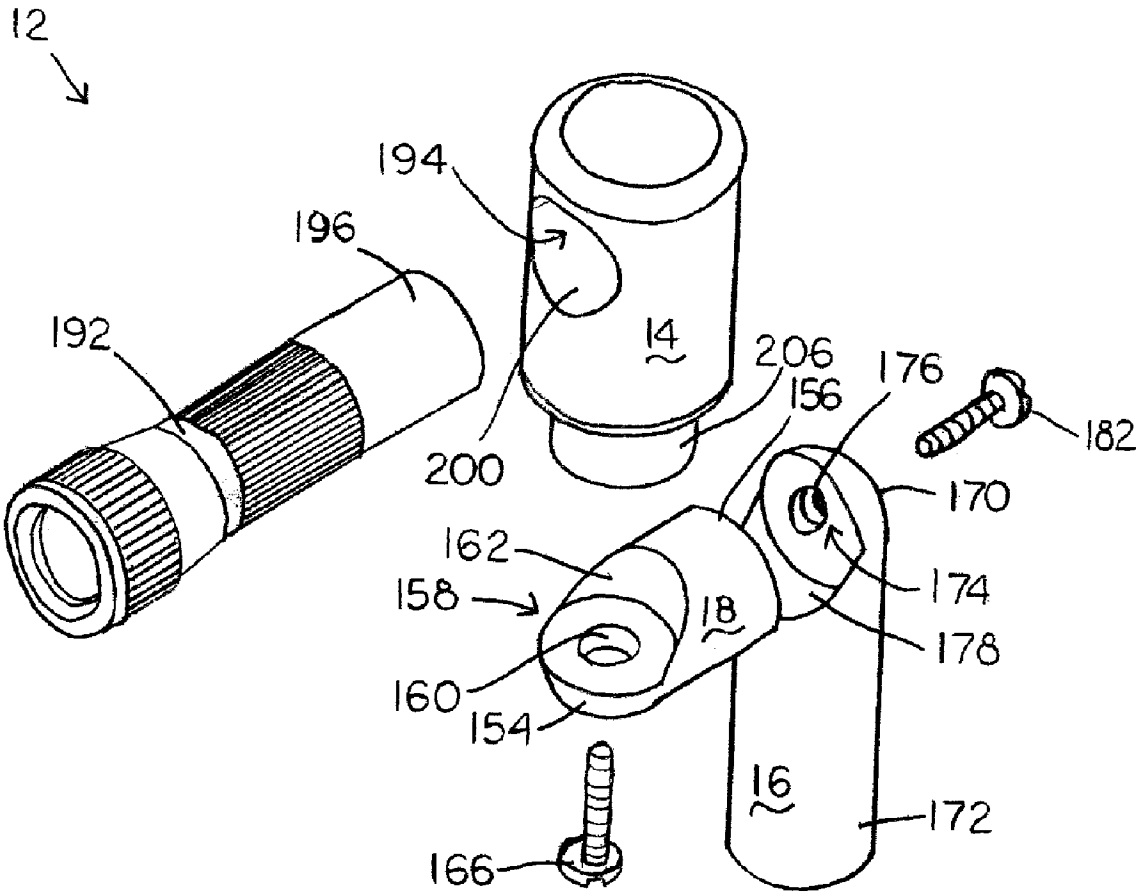
FIG. 15 is an exploded view of an adjustable mount of FIG. 13 with the flashlight removed according to the present invention.
Figure 16:
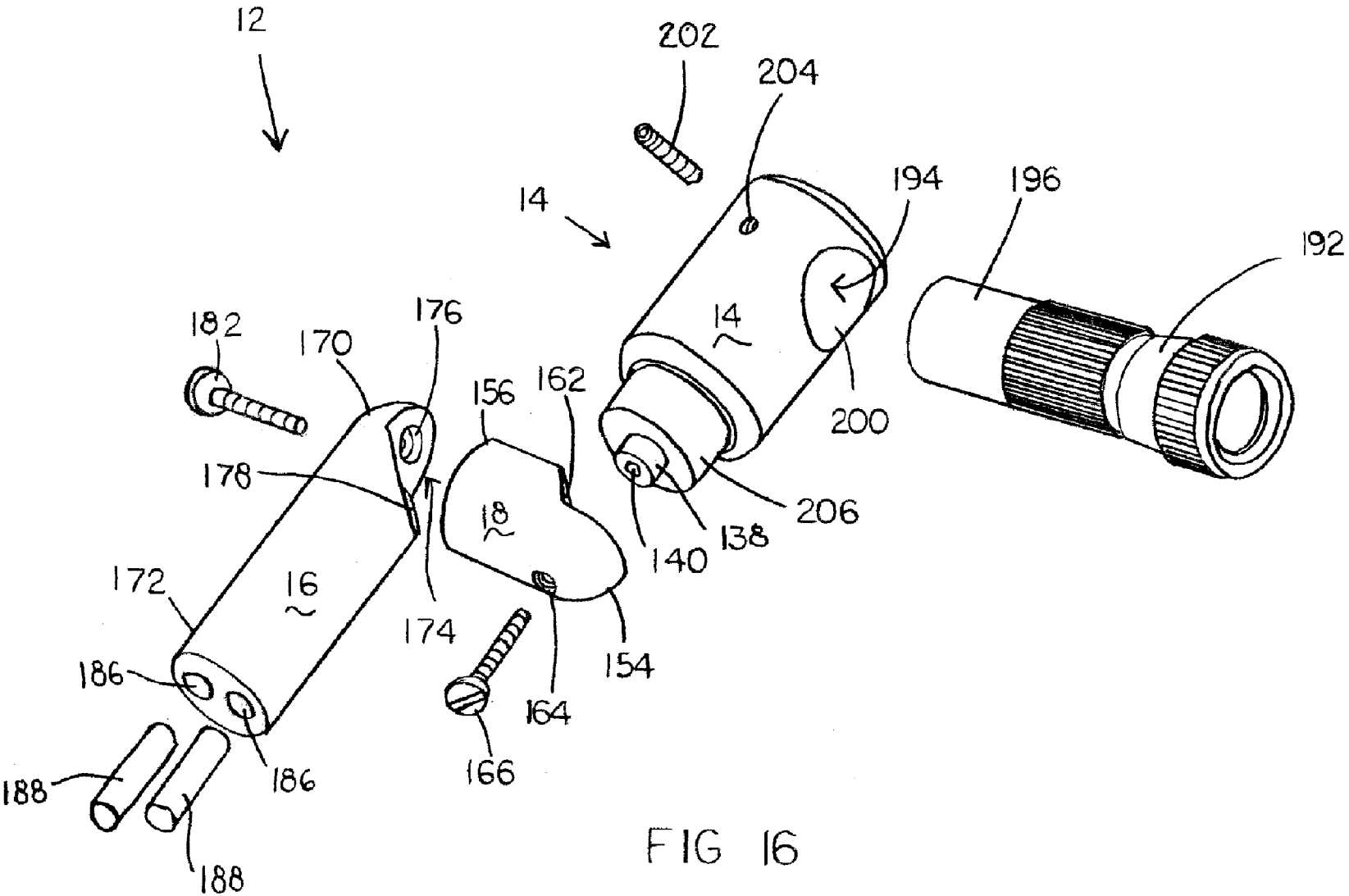
FIG. 16 is an exploded view of an adjustable mount of FIG. 13 with the flashlight removed according to the present invention.

FIG. 13 shows the embodiment 12 of the adjustable mount to receive an existing flashlight 192. The difference between the embodiment 10 of the adjustable mount to receive an existing flashlight and the embodiment 12 of the adjustable mount with the integrated flashlight is the flashlight receiving body 14. FIGS. 15 and 16 show a one piece molded flashlight receiving body 14, which does not require the many electrical components described for the embodiment 10 shown in FIGS. 1-12. The flashlight receiving body 14 includes a flashlight receiving hole 194, which is shown as a through hole to receive the end 196 of the flashlight 192. The flashlight receiving hole 194 does not have to be a through hole, but could also be a socket to receive the end 196 of the flashlight 192. FIG. 13 shows a switch 198 of the flashlight 192. The flashlight 192 can be secured in the flashlight hole 194 with a tight frictional fit between the flashlight 192 and the interior wall 200 of the flashlight hole 194. The flashlight 192 could also be secured in the flashlight hole 194 by using a set screw 202 and set screw hole 204, as shown in FIG. 16. The embodiment 12 of the adjustable mount of FIGS. 13-16 similarly includes a support body 16 and a connecting body 18 that are connected in the same manner as was described for the embodiment 10 shown in FIGS. 1-12. The one piece molded flashlight receiving body 14 includes a rotation end 206 with the rotation boss 138. The rotation end 206 replaces the rotation end cap 126 of the embodiment 10 shown in FIGS. 1-12 and is positioned into the round cutout 158 of the flashlight end 154 of the connecting body 18. The rotation boss 138 fits into the rotation boss socket 160 of the flashlight end 154 in the same manner as described for the embodiment 10 of FIGS. 1-12. The flashlight receiving body 14 connects to connecting body 18 in the same manner as described for the embodiment 10 of FIGS. 1-12 using the screw 166, hole 164, rotation boss socket 160, screw hole 140 and rotation boss 138.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. An adjustable mount for a flashlight with two points of rotation, comprising:

a flashlight receiving body adapted to receive a flashlight;

a connecting body rotatably connected to said flashlight receiving body, said connecting body having a length with a first end and second end and a width that is less than said length forming a cylindrical shape, said connecting body having an axis line running along said length from said first end to said second end of said connecting body;

a support body rotatably connected to said connecting body, said support body having a length with a first end and second end and a width that is less than said length;

wherein said support body directly connects to said connecting body at a right angle near said second end, such that an extension of the said axis line of said connecting body is always fixed at a right angle to said axis line of said support body, wherein said support body is connected to said connecting body such that said support body rotates about said connecting body at said direct connection between said support body and said connecting body forming a first point of rotation of said two rotation points, wherein said flashlight receiving body directly connects to said connecting body at a right angle and is always at a right angle to said connecting body, and wherein said flashlight receiving is connected to said connecting body such that said flashlight receiving rotates about said connecting body at said direct connection between said flashlight receiving body and said connecting body forming a second point of rotation of said two rotation points; and wherein said support body includes at least one magnet in said first end adapted for connecting said support body with a magnetic surface.

2. The adjustable mount of claim 1, wherein said support body includes a rotation boss socket at said connection between said support body and said connecting body, wherein said connecting body includes a rotation boss which mounts into said rotation boss socket of said support body at said connection between said support body and said connecting body, wherein said connecting body includes a rotation boss socket at said connection between said flashlight receiving body and said connecting body, and wherein said flashlight receiving body includes a rotation boss which mounts into said rotation boss socket of said connecting body at said connection between said flashlight receiving body and said connecting body.

3. The adjustable mount of claim 2, wherein said flashlight receiving body includes a flashlight socket adapted to receive a flashlight.

4. The adjustable mount of claim 3, wherein said flashlight socket is a through hole.

5. The adjustable mount of claim 1, wherein said flashlight receiving body includes a flashlight socket adapted to receive a flashlight.

6. The adjustable mount of claim 5, wherein said flashlight socket is a through hole.

7. The adjustable mount of claim 1, wherein said flashlight receiving body includes an integrated flashlight as part of said flashlight receiving body that is non-removable as a separate entity from said flashlight receiving body, said integrated flashlight including a flashlight body.

8. The adjustable mount of claim 7, wherein said flashlight receiving body includes a flashlight body socket to receive said flashlight body, and wherein said flashlight body includes a serviceable light source adapted to be activated by a battery.

9. The adjustable mount of claim 8, wherein said flashlight receiving body includes a battery socket to receive the battery.

10. An adjustable mount for a flashlight, comprising:

a flashlight receiving body adapted to receive a flashlight;

a connecting body rotatably connected to said flashlight receiving body;

a support body rotatably connected to said connecting body;

wherein said support body directly connects to said connecting body at a right angle, wherein said support body is connected to said connecting body such that said support body rotates about said connecting body at said direct connection between said support body and said connecting body, wherein said flashlight receiving body directly connects to said connecting body at a right angle, and wherein said flashlight receiving body is connected to said connecting body such that said flashlight receiving rotates about said connecting body at said direct connection between said flashlight receiving body and said connecting body; and wherein said support body includes at least one magnet in said first end adapted for connecting said support body with a magnetic surface.

11. The adjustable mount of claim 10, wherein said flashlight receiving body includes a flashlight socket adapted to receive a flashlight.

12. The adjustable mount of claim 11, wherein said flashlight socket is a through hole.

13. The adjustable mount of claim 10, wherein said support body includes a rotation boss socket at said direct connection between said support body and said connecting body, wherein said connecting body includes a rotation boss which mounts into said rotation boss socket of said support body at said direct connection between said support body and said connecting body, wherein said connecting body includes a rotation boss socket at said direct connection between said flashlight receiving body and said connecting body, and wherein said flashlight receiving body includes a rotation boss which mounts into said rotation boss socket of said connecting body at said direct connection between said flashlight receiving body and said connecting body.

14. The adjustable mount of claim 13, wherein said flashlight receiving body includes a flashlight socket adapted to receive a flashlight.

15. The adjustable mount of claim 14, wherein said flashlight socket is a through hole.

16. The adjustable mount of claim 13, wherein said flashlight receiving body includes an integrated flashlight as part of said flashlight receiving body that is non-removable as a separate entity from said flashlight receiving body, said integrated flashlight including a flashlight body.

17. The adjustable mount of claim 16, wherein said flashlight receiving body includes a flashlight body socket to receive said flashlight body, and wherein said flashlight body includes a serviceable light source adapted to be activated by a battery.

18. The adjustable mount of claim 17, wherein said flashlight receiving body includes a battery socket to receive the battery.

* * * * *